US010307902B2

(12) United States Patent
Wang

(10) Patent No.: US 10,307,902 B2
(45) Date of Patent: Jun. 4, 2019

(54) STAPLER HAVING A NAIL GUIDING MECHANISM

(71) Applicant: APEX MFG. CO., LTD., Taichung (TW)

(72) Inventor: Jing- Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 472 days.

(21) Appl. No.: 15/072,075

(22) Filed: Mar. 16, 2016

(65) Prior Publication Data

US 2017/0266799 A1 Sep. 21, 2017

(51) Int. Cl.
*B25C 5/16* (2006.01)

(52) U.S. Cl.
CPC ..... *B25C 5/1665* (2013.01); *B25C 5/1658* (2013.01)

(58) Field of Classification Search
CPC ..... B25C 5/1658; B25C 5/1665; B25C 5/06; B25C 5/1637; B25C 1/005
See application file for complete search history.

(56) References Cited

U.S. PATENT DOCUMENTS 2,117,741 A * 5/1938 Polzer ..... B25C 5/1603 227/109
5,692,665 A * 12/1997 Lee ..... B25C 5/1658 227/109
5,873,509 A * 2/1999 Liao ..... B25C 1/005 227/109
6,076,720 A * 6/2000 Deng ..... B25C 5/025 227/109
6,237,827 B1 * 5/2001 Reckelhoff ..... B25C 5/0292 227/130
6,279,808 B1 * 8/2001 Larsen ..... B25C 1/00 227/119
6,789,718 B2 * 9/2004 Canlas ..... B25C 7/00 227/107
6,851,594 B1 * 2/2005 Huang ..... B25C 5/1658 227/109
8,430,290 B2 * 4/2013 Tebo ..... B25C 1/005 227/107
8,695,860 B2 * 4/2014 Wang ..... B25C 5/1665 227/109
9,221,163 B2 * 12/2015 Wang ..... B25C 5/06
9,346,156 B1 * 5/2016 Fago ..... B25C 1/00
(Continued)

FOREIGN PATENT DOCUMENTS

TW M355151 U 4/2009

*Primary Examiner* — Alexander M Valvis
*Assistant Examiner* — Thomas M Wittenschlaeger
(74) *Attorney, Agent, or Firm* — Muncy, Geissler, Olds & Lowe, P.C.

(57) ABSTRACT

A stapler is provided, including: a main body, having a nail outlet and a cartridge, an opening of the cartridge communicating with the nail outlet; a nail guiding mechanism, including a guiding plate facing the opening and a biasing mechanism disposed between the main body and the guiding plate, the guiding plate having an upper end away from the nail outlet, the biasing mechanism abutting against the guiding plate and normally biasing the upper end toward the cartridge; a striker, movably disposed within the main body; an operable mechanism, movably connected to the main body, being operable to drive the striker to move toward the nail outlet.

12 Claims, 9 Drawing Sheets

(56) References Cited

U.S. PATENT DOCUMENTS

| | | | | |
|---|---|---|---|---|
| 2008/0156844 | A1* | 7/2008 | Braganza | B25C 5/06 227/109 |
| 2012/0043366 | A1* | 2/2012 | Wang | B25C 5/06 227/139 |

* cited by examiner

STAPLER HAVING A NAIL GUIDING MECHANISM

BACKGROUND OF THE INVENTION

Field of the Invention

The present invention relates to a stapler, and more particularly to a stapler having a nail guiding mechanism.

Description of the Prior Art

A nail guiding mechanism is disclosed in U.S. Pat. No. 5,692,665, wherein two guiding feet optionally swing to a front of a nail rail via elasticity so as to centralize a nail, the two guiding feet are pivotable and can swing toward the nail rail via elasticity. In this type of structure, the guiding feet are inclined toward a nail outlet when centralizing the nail; therefore, a distal end of the nail tends to inclined toward a cartridge and is stuck easily.

In addition, to allow a stapler to use the nail in different dimensions, as disclosed in TWM 355151, a frontal end of the cartridge is provided with a pressing board, a receiving hole of a body has a controlling member, the controlling member can optionally push the pressing board, the pressing board can move between a frontal end and a rear end of the body, so a user can control the controlling member to move the pressing board so as to control a size of a gap of the stapler. Therefore, when the stapler is struck, a hitting board will not push two said nails, affect a striking effect and cause the nails to be stuck. However, the controlling member of this type of stapler needs to be adjusted according to different nails, and the user may forget to adjust the controlling member and cause two said nails to be struck at the same time.

The present invention has arisen to mitigate and/or obviate the afore-described disadvantages.

SUMMARY OF THE INVENTION

The major object of the present invention is to provide a stapler having a nail guiding mechanism which can prevent a nail from being stuck and is applicable to the nail in different dimensions.

To achieve the above and other objects, a stapler having a nail guiding mechanism is provided, including: a main body, having a nail outlet and a cartridge, an opening of the cartridge communicating with the nail outlet; a nail guiding mechanism, including a guiding plate facing the opening and a biasing mechanism disposed between the main body and the guiding plate, the guiding plate having an upper end away from the nail outlet, the biasing mechanism abutting against the guiding plate and normally biasing the upper end toward the cartridge; a striker, movably disposed within the main body; an operable mechanism, movably connected to the main body, being operable to drive the striker to move toward the nail outlet.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
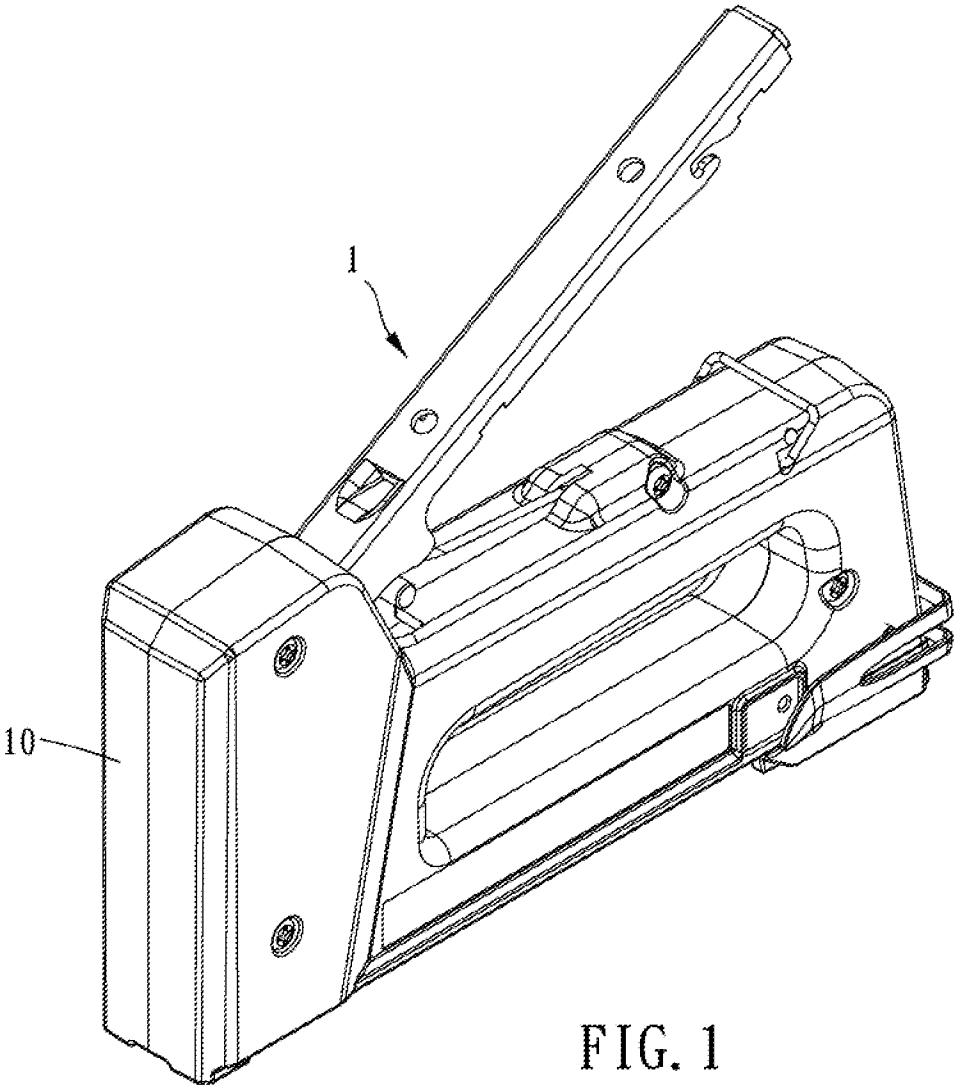
FIG. 1 is a perspective view of a preferred embodiment of the present invention.
Figure 2:
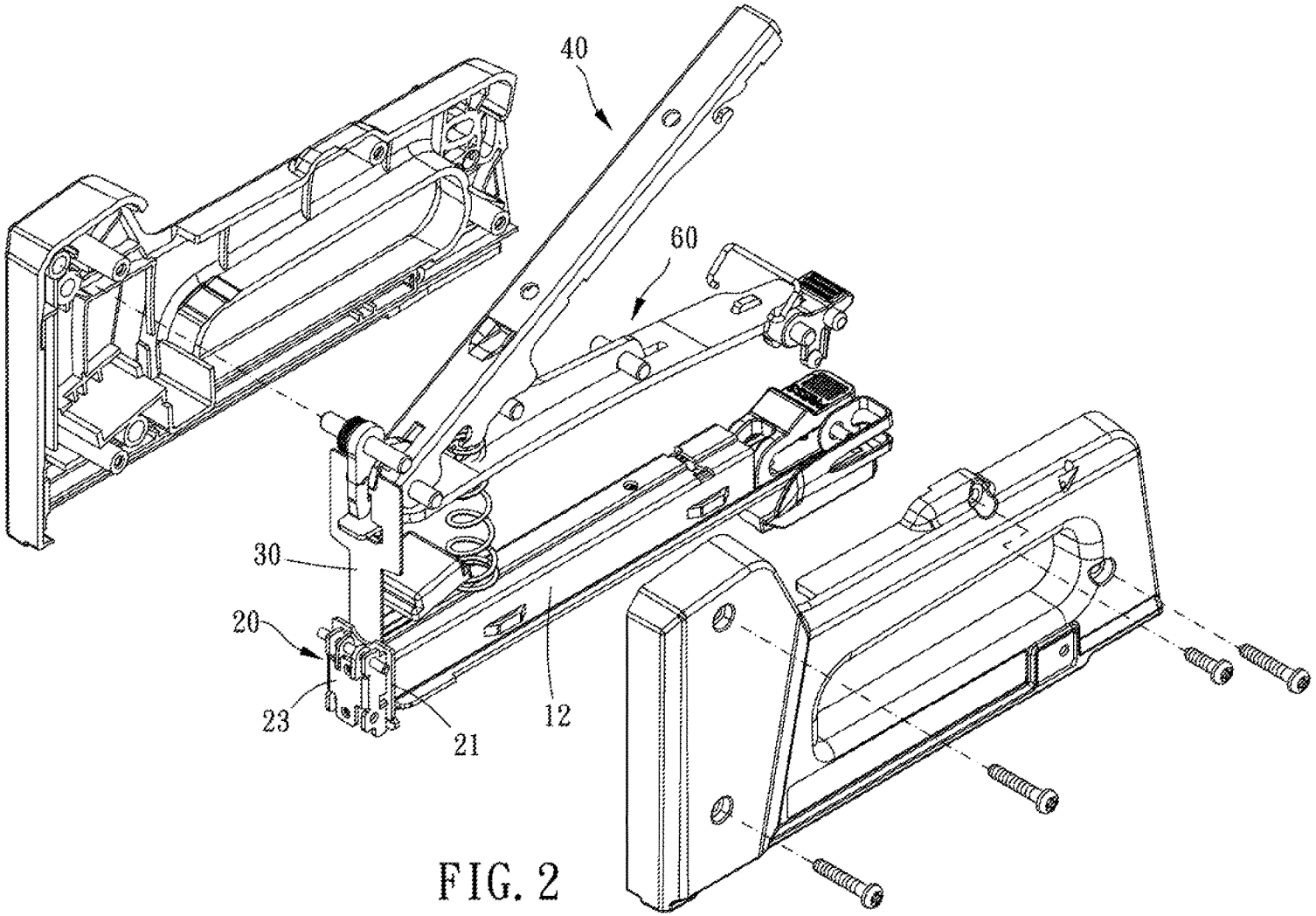
FIG. 2 is a breakdown view of the preferred embodiment of the present invention.
Figure 3:
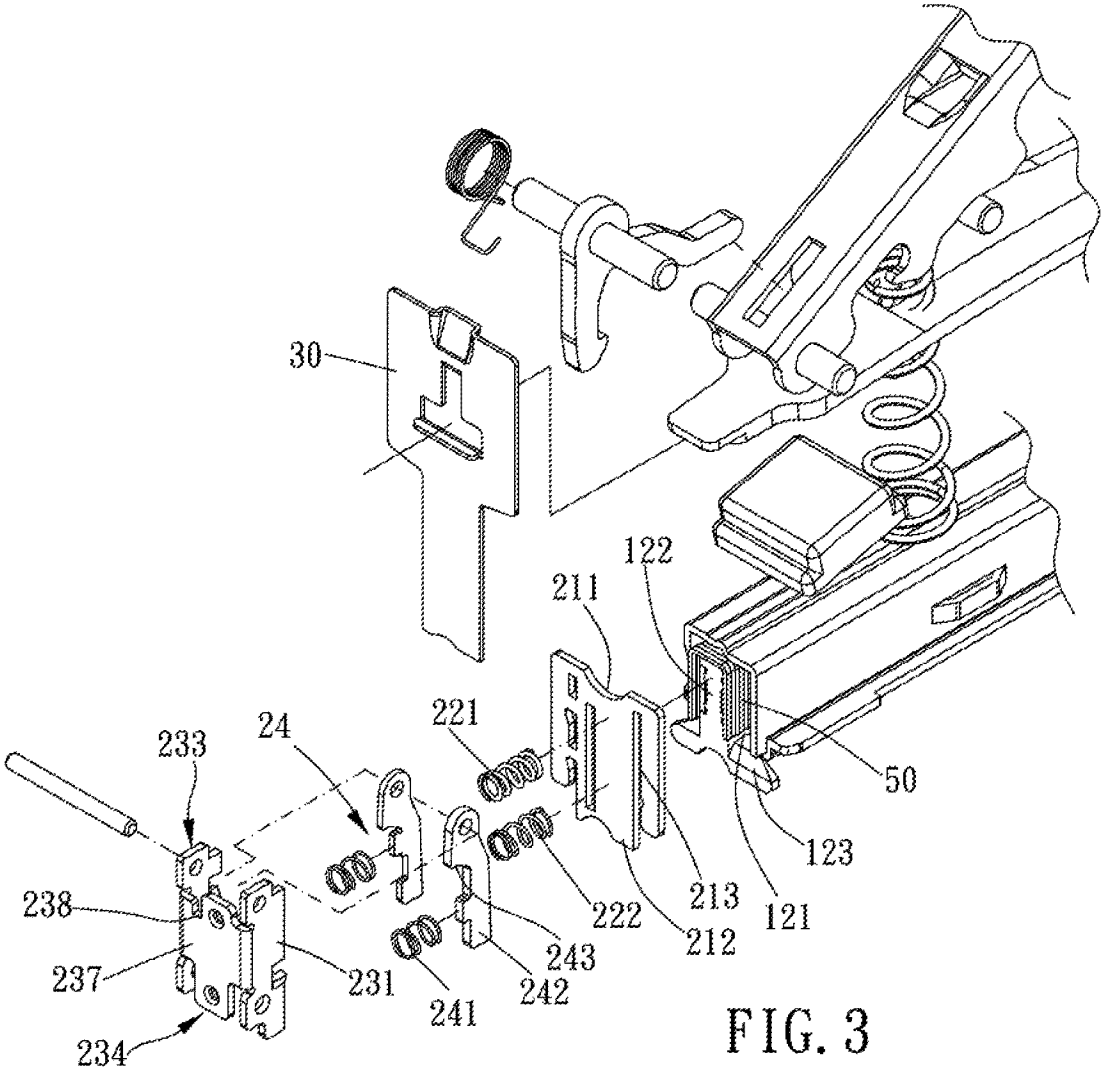
FIG. 3 is a partial breakdown view of the preferred embodiment of the present invention.
Figure 4:
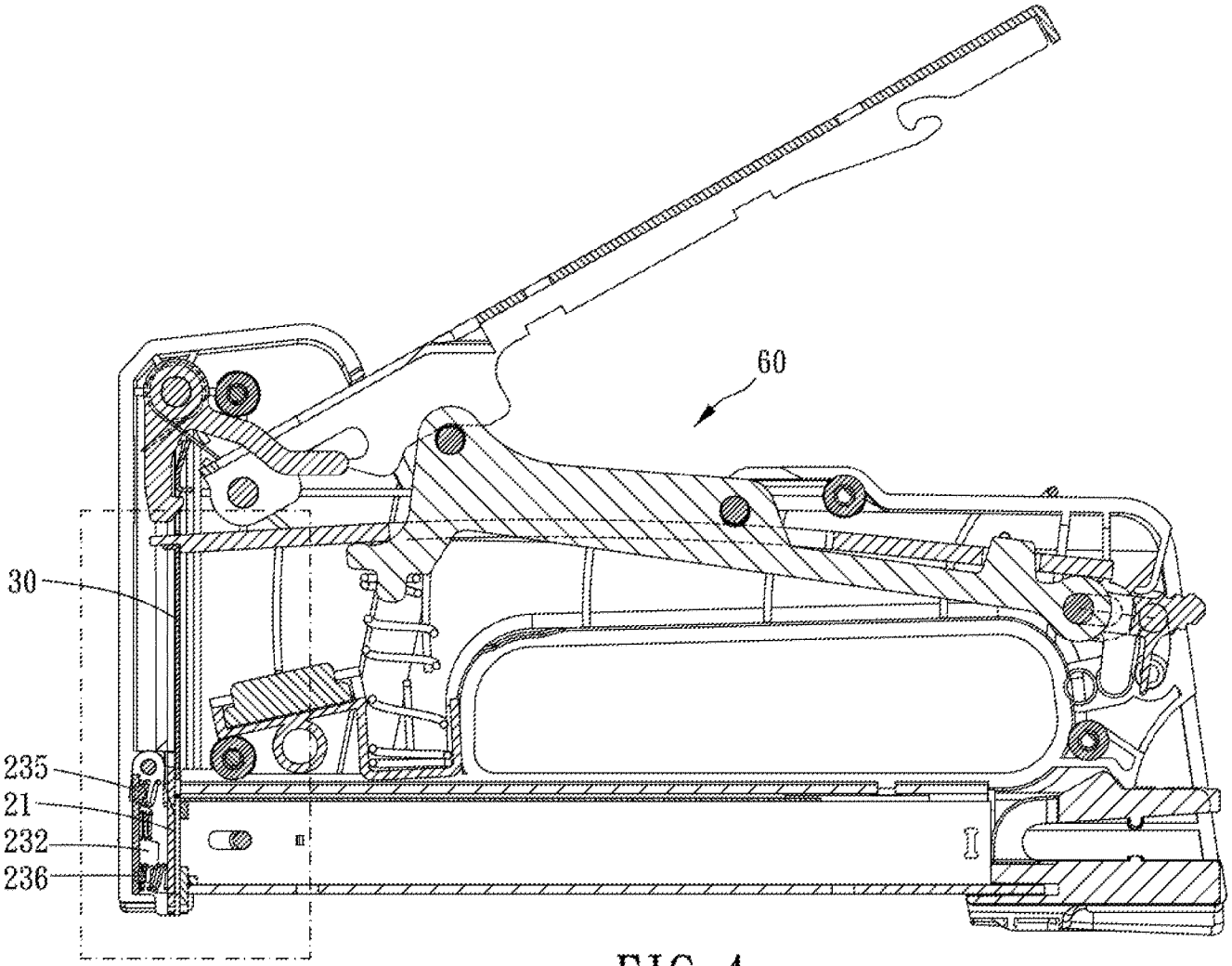
FIG. 4 is a first cross-sectional view of the preferred embodiment of the present invention.
Figure 5:
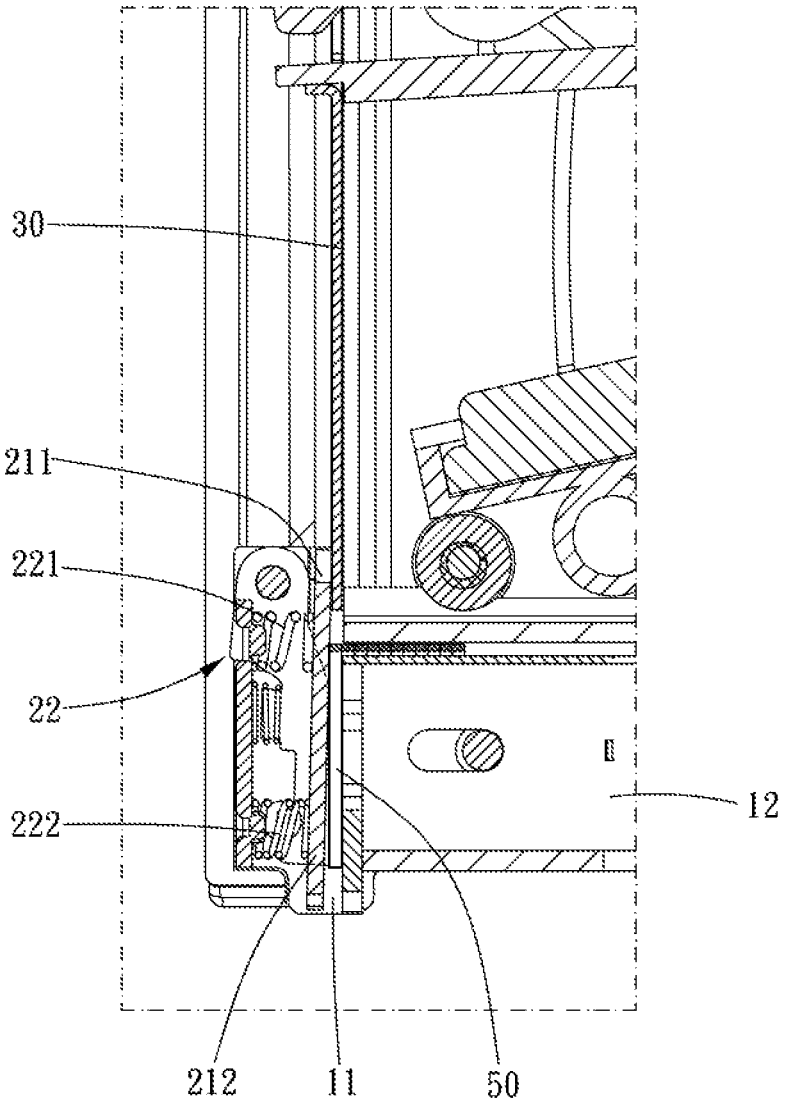
FIG. 5 is a partially-enlarged view of FIG. 4.

Please refer to FIGS. 1 to 5 for a preferred embodiment of the present invention. A stapler 1 having a nail guiding mechanism includes a main body 10, a nail guiding mechanism 20, a striker 30 and an operable mechanism 40.

The main body 10 has a nail outlet 11 and a cartridge 12, an opening 121 of the cartridge 12 communicates with the nail outlet 11, and the opening 121 is for a nail 50 to be charged out from the cartridge 12. The nail guiding mechanism 20 includes a guiding plate 21 facing the opening 121 and a biasing mechanism 22 disposed between the main body 10 and the guiding plate 21, the guiding plate 21 has an upper end 211 away from the nail outlet 11, and the biasing mechanism 22 abuts against the guiding plate 21 and normally biases the upper end 211 toward the cartridge 12. The striker 30 is movably disposed within the main body 10. The operable mechanism 40 is movably connected to the main body 10 and operable to drive the striker 30 to move toward the nail outlet 11. Through the biasing mechanism 22 normally biasing the upper end 211 toward the cartridge 12, during the action of the striker 30 striking the nail 50 and the discharge of the nail 50 out of the nail outlet 11, it can be ensured that the nail 50 biases away from instead of close to an interior of the cartridge 12, so the nail 50 will not be stuck.

Specifically, the biasing mechanism 22 includes a first elastic member 221 and a second elastic member 222 abutting against the guiding plate 21, the guiding plate 21 further includes a lower end 212 opposite to the upper end 211, the first and second elastic members 221, 222 are near and abut against the upper end 211 and the lower end 212 respectively, and the first elastic member 221 is greater than the second elastic member 222 in elastic coefficient to produce biasing effect. More specifically, the nail guiding mechanism 20 further includes a base 23 disposed in the main body 10, the base 23 has two side walls 231 which are arranged in interval substantially parallel to each other and correspond to each other, the two side walls 231 and the guiding plate 21 define a space 232, and the biasing mechanism 22 is located in the space 232. The base 23 is pivoted to the main body 10 via a top end 233 thereof to ensure the upper end 211 of the guiding plate 21 normally moves toward the cartridge 12. The top end 233 and a bottom end 234 of the base 23 are respectively provided with a first connecting base 235 for the first elastic member 221 to be connected thereto and a second connecting base 236 for the second elastic member 222 to be connected thereto so as to make the first and second elastic members 221, 222 stably arranged, and the first and second connecting bases 235, 236 may be protrusive or recessed. However, the biasing mechanism may include only one elastic member abutting against the guiding plate 21, and the elastic member is near the upper end 211 to produce biasing effect; or the biasing mechanism may be an elastic arm which is connected to a proper position of the guiding plate 21, and the elastic arm normally swings toward the cartridge.

Preferably, the nail guiding mechanism 20 further includes at least one supporting assembly 24 arranged between the base 23 and the guiding plate 21, the guiding plate 21 further includes at least one through slot 213, and each said supporting assembly 24 is retractably disposed within one said through slot 213. The base 23 includes a bottom wall 237 parallel to the guiding plate 21, a top of the bottom wall 237 includes at least one guiding slot 238, each said supporting assembly 24 includes an elastic member 241 and a supporting member 242 pivoted to the base 23, the elastic member 241 abuts against and between the bottom wall 237 and the supporting member 242, and the supporting member 242 has a guiding shoulder portion 243 which is pivotably disposed within the guiding slot 238 to guide and stabilize the supporting member 242.

Specifically, the cartridge 12 has a nail rail 122 arranged along the cartridge 12 and toward the opening 121 of the cartridge 12, the nail rail 122 has a longitudinal direction and an inclined face 123 near the nail outlet 11, the inclined face 123 is inclined in a direction from the nail outlet 11 toward a center of the cartridge 12, the nail guiding mechanism 20 includes two said supporting assemblies 24, the guiding plate 21 includes two said through slots 213, one of the two through slots 213 is circumferentially closed, and the other of the two through slots 213 has an end open toward the nail outlet 11 and corresponding to the inclined face 123. As viewed in the longitudinal direction, the two through slots 213 are located on two opposite sides of the nail rail 122, and the inclined face 123 allows one said supporting member 242 to be partially arranged into the cartridge 12 to centralize the nails in different dimensions. Through cooperation of the two supporting members 242, the two through slots 213 and the inclined face 123, the nails in various dimensions are applicable to the stapler 1, for example, T-shaped nails, U-shaped nails, reversed U-shaped nails or thick reversed U-shaped nails.

Figure 6:
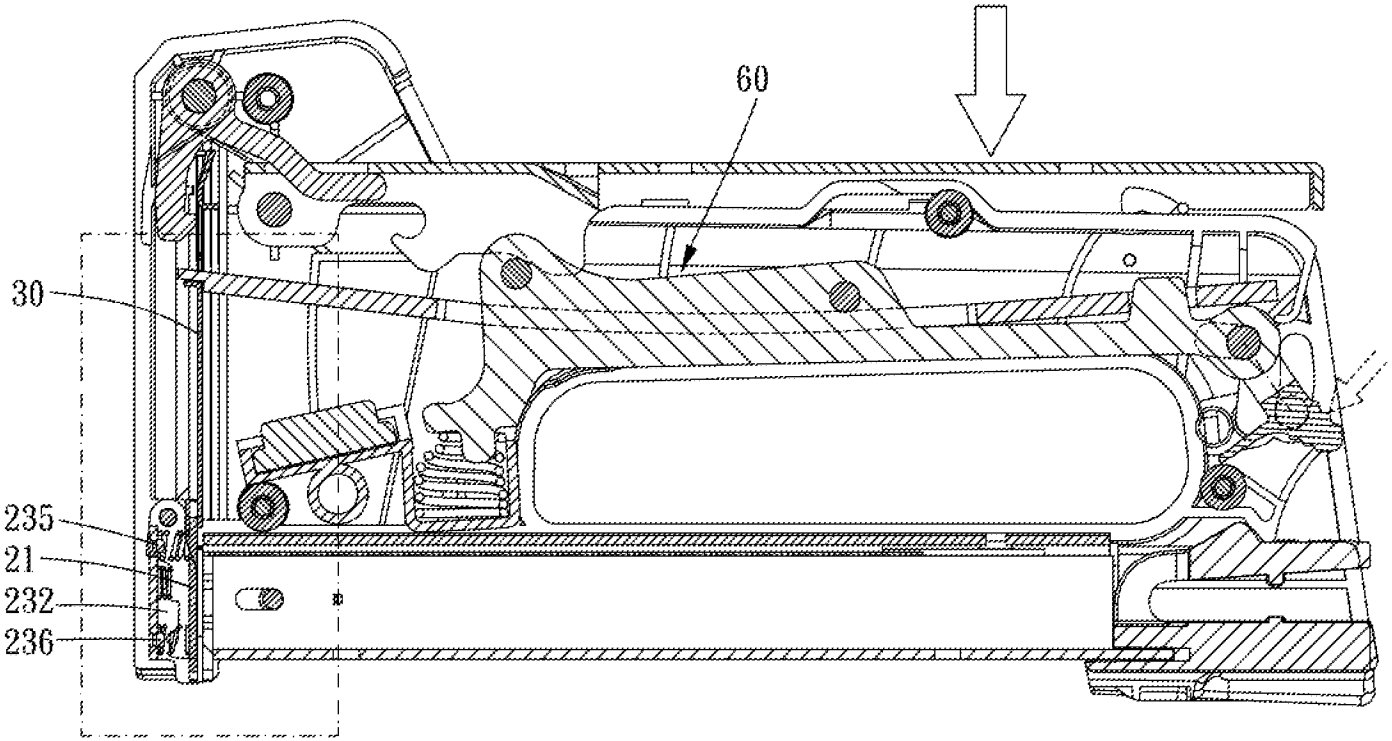
FIG. 6 is a second cross-sectional view of the preferred embodiment of the present invention.
Figure 7:
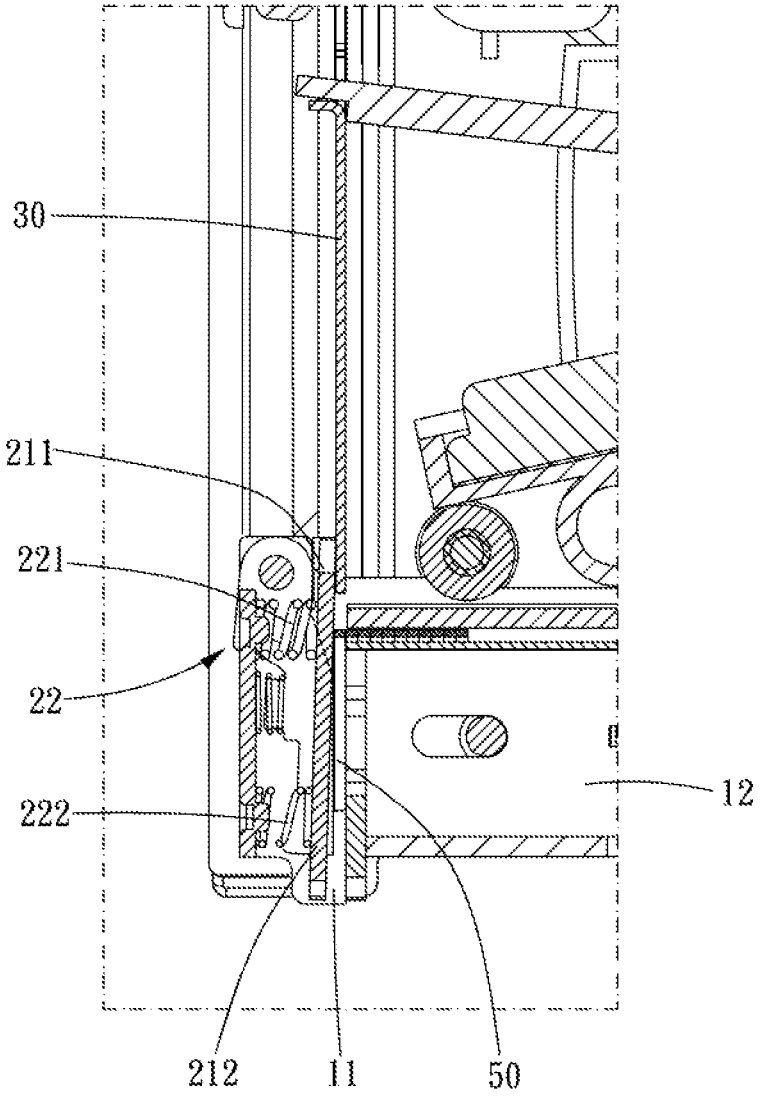
FIG. 7 is a partially-enlarged view of FIG. 6.
Figure 8:
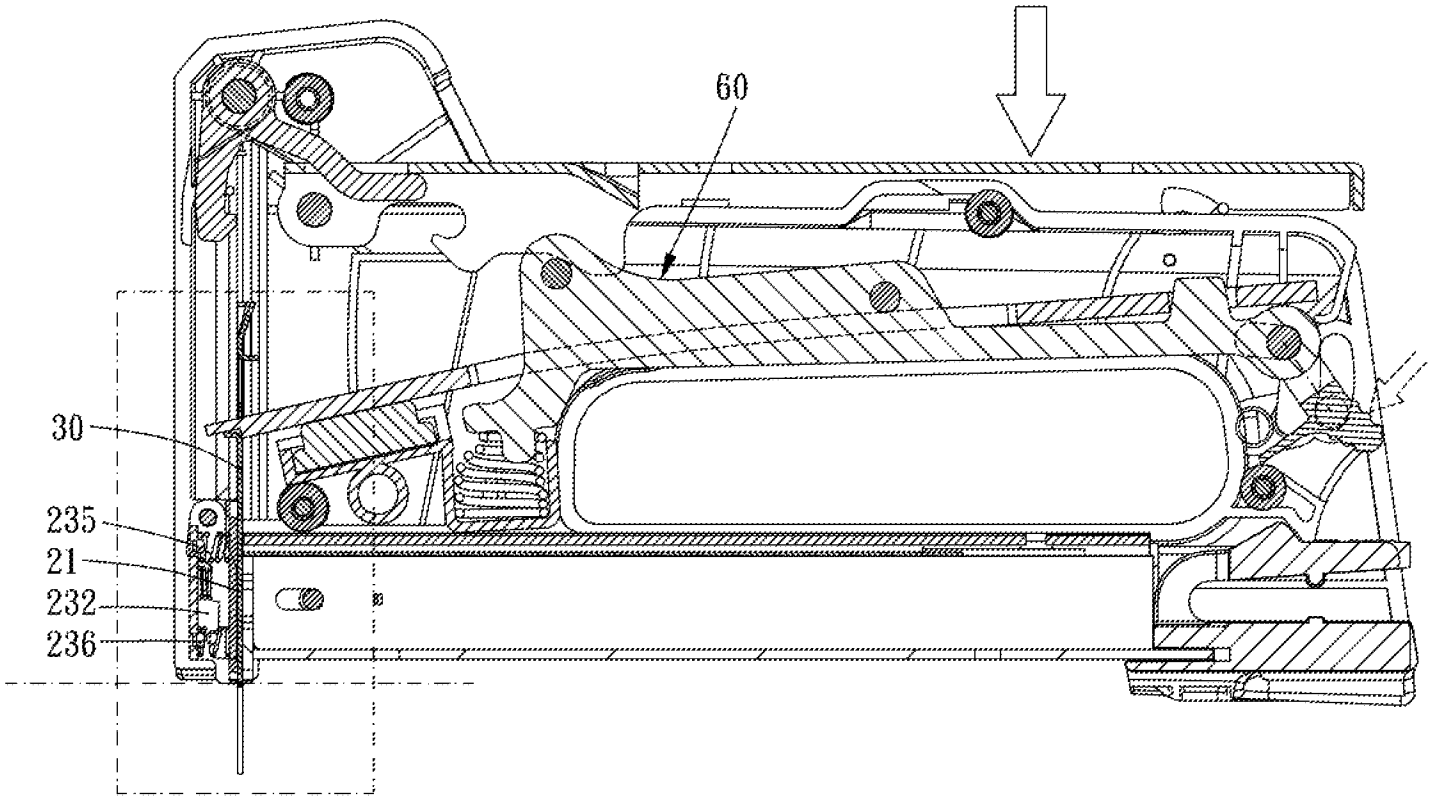
FIG. 8 is a third cross-sectional view of the preferred embodiment of the present invention.
Figure 9:
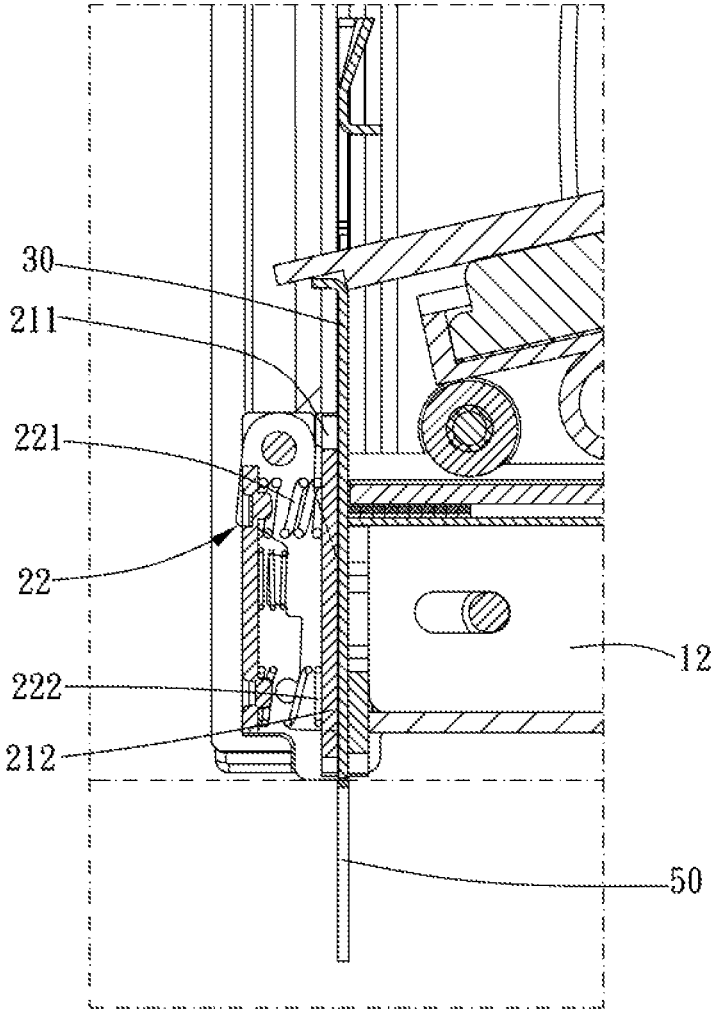
FIG. 9 is a partially-enlarged view of FIG. 8.

Please further refer to FIGS. 6 to 9. In actual operation, a force-accumulating mechanism 60 triggers the striker 30 to strike toward the nail outlet 11, the biasing mechanism 22 abuts against the upper end 211 of the guiding plate 21 and abuts against the nail 50, and the guiding plate 21 moves from the upper end 211 toward the lower end 212 and gradually away from the cartridge 12 so that the nail 50 biases away from instead of close to an interior of the cartridge 12, so the nail 50 will not be stuck.

While we have shown and described various embodiments in accordance with the present invention, it should be clear to those skilled in the art that further embodiments may be made without departing from the scope of the present invention.

What is claimed is:

1. A stapler having a nail guiding mechanism, including:

a main body, having a nail outlet and a cartridge, an opening of the cartridge communicating with the nail outlet;

a nail guiding mechanism, including a guiding plate facing the opening and a biasing mechanism disposed between the main body and the guiding plate, the guiding plate having an upper end away from the nail outlet, the biasing mechanism abutting against the guiding plate and normally biasing the upper end toward the cartridge;

a striker, movably disposed within the main body;

an operable mechanism, movably connected to the main body, being operable to drive the striker to move toward the nail outlet;

wherein the nail guiding mechanism further includes at least one supporting member, the guiding plate is disposed and movable between the at least one supporting member and the opening of the cartridge, and a part of the at least one supporting member is protrudable to be between the guiding plate and the opening of the cartridge;

wherein when the guiding plate is urged on a nail, the guiding plate is slant relative to a face of the striker facing the guiding plate, and a lower end of the guiding plate is farther away from the opening of the cartridge than the upper end of the guiding plate;

wherein the nail guiding mechanism further includes a base disposed in the main body, the nail guiding mechanism further includes at least one supporting assembly including the at least one supporting member and arranged between the base and the guiding plate, the guiding plate further includes at least one through slot, and each of the at least one supporting member is retractably disposed within one said through slot.

2. The stapler having a nail guiding mechanism of claim 1, wherein the biasing mechanism includes an elastic member abutting against the guiding plate, and the elastic member is near the upper end.

3. The stapler having a nail guiding mechanism of claim 1, wherein the biasing mechanism includes a first elastic member and a second elastic member which abut against the guiding plate, the guiding plate further includes a bottom end opposite to the upper end, and the first and second elastic members are near the upper and lower ends respectively.

4. The stapler having a nail guiding mechanism of claim 3, wherein the first elastic member is greater than the second elastic member in elastic coefficient.

5. The stapler having a nail guiding mechanism of claim 3, wherein a top end and a bottom end of the base are respectively provided with a first connecting base for the first elastic member to be connected thereto and a second connecting base for the second elastic member to be connected thereto.

6. The stapler having a nail guiding mechanism of claim 5, wherein the base is pivoted to the main body via the top end thereof.

7. The stapler having a nail guiding mechanism of claim 1, wherein the nail guiding mechanism further includes a base disposed in the main body, the base further has two side walls which are arranged in interval substantially parallel to each other and correspond to each other, the two side walls and the guiding plate define a space, and the biasing mechanism is located in the space.

8. The stapler having a nail guiding mechanism of claim 1, wherein the base includes a bottom wall parallel to the guiding plate, a top of the bottom wall includes at least one guiding slot, each of the at least one supporting assembly includes an elastic member and one of the supporting member which is pivoted to the base, the elastic member abuts against and between the bottom wall and the supporting member, and the supporting member has a guiding shoulder portion which is pivotably disposed within the guiding slot.

9. The stapler having a nail guiding mechanism of claim 8, wherein the base further has two side walls which are arranged in interval substantially parallel to each other and correspond to each other, the two side walls and the guiding plate define a space, and the biasing mechanism is located in the space, the cartridge has a nail rail arranged along the cartridge and toward the opening of the cartridge, the nail rail has a longitudinal direction and an inclined face near the nail outlet, the inclined face is inclined along a direction from the nail outlet toward a center of the cartridge, the nail guiding mechanism includes two said supporting assemblies, the guiding plate includes two said through slots, one of the two through slots is circumferentially closed, the other of the two through slots has an end open toward the nail outlet and corresponding to the inclined face, as viewed in the longitudinal direction, the two through slots are located on two opposite sides of the nail rail, and the inclined face allows one said supporting member to be partially arranged into the cartridge.

10. The stapler having a nail guiding mechanism of claim 1, wherein the upper end of the guiding plate is abutted against the striker.

11. The stapler having a nail guiding mechanism of claim 1, wherein a face of the guiding plate facing the opening and configured to contact the nail is slant relative to the face of the striker facing the guiding plate when the guiding plate is urged on the nail.

12. The stapler having a nail guiding mechanism of claim 1, wherein a face of said supporting assembly facing the opening is slant relative to a face of the guiding plate facing the opening when the guiding plate is urged on the nail.

* * * * *